US007127867B2

(12) United States Patent
Smeja et al.

(10) Patent No.: US 7,127,867 B2
(45) Date of Patent: Oct. 31, 2006

(54) METAL SNOW GUARD

(75) Inventors: George Smeja, McHenry, IL (US); Michael V. Smeja, McHenry, IL (US); Troy Livingston, Northbrook, IL (US)

(73) Assignee: Sno-Gem, Inc., McHenry, IL (US)

( * ) Notice: Subject to any disclaimer, the term of this patent is extended or adjusted under 35 U.S.C. 154(b) by 0 days.

(21) Appl. No.: 11/120,122

(22) Filed: May 2, 2005

(65) Prior Publication Data

US 2005/0217184 A1 Oct. 6, 2005

Related U.S. Application Data

(62) Division of application No. 10/360,324, filed on Feb. 7, 2003, now Pat. No. 6,922,948.

(60) Provisional application No. 60/356,049, filed on Feb. 11, 2002.

(51) Int. Cl.
*E04B 1/08* (2006.01)
*E04D 13/00* (2006.01)

(52) U.S. Cl. ..... 52/745.21; 52/24; 52/60; 228/246

(58) Field of Classification Search ..... 52/24, 52/60, 62; 228/245, 246
See application file for complete search history.

(56) References Cited

U.S. PATENT DOCUMENTS 5,072,552 A * 12/1991 Sauder ..... 52/62
5,333,419 A 8/1994 Hickner
5,471,799 A 12/1995 Smeja et al.
5,664,374 A 9/1997 Lee
5,675,939 A 10/1997 Hickner
5,901,507 A 5/1999 Smeja et al.
5,913,779 A * 6/1999 Edvardsen ..... 52/58
6,715,237 B1 4/2004 Batt, Sr.

* cited by examiner

*Primary Examiner*—Anthony D. Barfield
(74) *Attorney, Agent, or Firm*—Fitch, Even, Tabin & Flannery

(57) ABSTRACT

A method of making a metal snow guard is disclosed. The snow guard has a solid layer of soldering material on its base to be heated and melted with application of heat to the upper side of the snow guard to solder the base to an underlying metal roof. The soldering material may be applied as spaced spots or projections providing a rough surface on the underside of the snow guard. The amount of solder and/or flux in the solid layer is limited so that the solder and/or flux does not flow outwardly from the snow guard and run down the metal roof thereby damaging or marring the metal roof surface. The snow guards may be formed of a few pieces of sheet metal. The projections of soldering material may be formed by forcing a paste of solder and flux through spaced holes in a plate or screen onto the base.

10 Claims, 13 Drawing Sheets

METAL SNOW GUARD

CROSS-REFERENCE TO RELATED APPLICATION

This is a divisional of prior of prior U.S. patent application Ser. No. 10/360,324, filed on Feb. 7, 2003 now U.S. Pat. No. 6,922,948, which is hereby incorporated by reference in its entirety.

This application claims the benefit of U.S. Provisional Application Ser. No. 60/356,049, filed Feb. 11, 2002, which is incorporated by reference in its entirety herein.

FIELD OF THE INVENTION

This invention relates to snow guards for restraining ice and snow from sliding down inclined surfaces of buildings, particularly inclined roofs.

BACKGROUND OF THE INVENTION

One particularly successful snow guard having a gem-like appearance and made of plastic and usually of colored plastic is disclosed in U.S. Pat. Nos. 5,901,507 and 5,471,700 to Smeja, et al. The present invention is not limited to this particular shape or kind of snow guard but is applicable to various other shapes and kinds of snow guards. The particular shapes and kinds of snow guards illustrated and described herein are the preferred embodiments of the invention and are merely exemplary.

The snow guards shown in the aforesaid patents have been very successful from a commercial standpoint and were made in plastic of different colors. This snow guard was not only purchased and installed because of its functional capabilities, but is also purchased and installed as a medallion in warm climates only because decorative and esthetic appeal on a building. There is a need to provide a similar shape of snow guard but in metal where the architect or building proprietor wants a particular color and material. Often, it is desired to make the snow guards of the same material as the roof, so that the snow guards blend in with the roof of the same color and same material. Although the plastic molded snow guards may be colored to have the appearance of copper for a copper metal roof, a gold appearance for a gold roof, a green appearance for a green metal roof, etc., the snow guards being made of plastic rather will still have a noticeable look of being made of a different material and often with a slight variation in color. Of course, some will want contrasting or accenting colors of snow guards for their roofs. Whatever the reason, there is a reason for making snow guards from flat metal sheets such as copper, stainless steel, terne metal, galbanum, zinc coated steel, lead coated copper, etc. In other instances, the metal sheets may have a color coating on the surface of metal sheet which is colored to meet an owner's desire for a slate roof, a shingle roof or a metal roof.

When making folded metal snow guards, the aesthetics are important for such a highly visible product. While the product could be folded from a single sheet or several metal sheets and joined together, it is preferred that the product appear substantially seamless or with a minimum of visible seams in the installed position. Further, because some of the metal sheets are expensive, it is preferred that the construction be made without excessive scrap waste. Usually, the sheet metal will be stamped with holes therein and with irregular shapes on the side edges for panel edges that are to be erected. This lends to the formation of scrap. Also, where the sheet is coated as with a color, it is less expensive to make a sheet colored on one side rather than two sides and to fold the sheet to form the snow guard with only the one-coated side being visible.

Typically, snow guards are fastened to roofs with fasteners such as screws or nails, with adhesives, or with solder when securing a metal snow guard to a metal roof. The typical solder operation of a worker applying solder and flux and heating them to liquify the solder and to form the solder connection is time consuming and expensive. That is, the installer will have a roll of solder wire and a flux material and he will lay the flux and the solder against an upper edge or underneath the upper edge of the snow guard inclined on the roof to heat the roof, the snow guard edge, the flux and the solder with a propane torch to melt or liquify the solder and bring the metal of the snow guard and roof to the temperature necessary for soldering together. Although the upper side edges of the snow guard may be soldered, the lower edges and the bottom edge of the snow guard may not be soldered or soldered only with extreme care to avoid running of solder along the roof surface below the snow guard. Good soldering technique is a difficult task to learn in that one really needs three hands with one hand to hold the snow guard in place on an inclined roof, a second hand to hold the solder, and a third hand to apply the flux. If too little solder is applied, a good connection to the roof is not attained. If too much solder or flux is applied, it will run down the expensive metal roof and mar its appearance. There is no good or easy way to remove any solder streaks from the metal roof without affecting its appearance.

Also, it is necessary to apply high temperature heat, e.g., 500°–600° F. from a torch to the snow guard to melt the underlying solder at about 370°–390° F. The snow guard will become so hot that the person doing the soldering cannot hold the snow guard in position while it is being soldered. If insufficient heat is applied and a weak, cold solder joint will be made between the snow guard and the roof. Thus, today commercial installers of snow guards attach them to the roof with fasteners or adhesives because of the difficulties in applying the right amount of solder, heat and a good soldering technique.

Thus, there is a need for a new method of attaching metal snow guards to metal roofs. Also, there is a need for new and improved snow guards.

SUMMARY OF THE INVENTION

As set forth in this disclosure, there is provided a new and improved manner of soldering a metal snow guard to a metal roof.

In accordance with the improved method of soldering the metal roof guard to a metal roof, it is preferred to provide a solid soldering material, for example, a sealed layer of solder with or without a flux thereon. In the preferred embodiment, the lead in the solder layer is coated over and covered with a layer of flux so that the solder will not oxidize and form an inert lead oxide that interferes with a good soldering of the snow guard to the roof. Often, the snow guards are not used for several months after there manufacture and the uncovered or unsealed solder may oxidize or crystallize and interfere with the attachment of the guard to the roof. In other embodiments, having snow guards made of materials other than copper, such as lead coated or stainless steel metals, there is a need for such an aggressive flux that this aggressive flux will be provided separately such as paste in a tube to be applied to the solder at the time of soldering. Typically, such a flux is a form of sulfuric acid in a paste form and the roof surface will be cleaned as with an abrasive pad and the flux can be applied to the roof and then the sealed solder layer can be placed on the solder paste and the top of the snow guard may be heated.

In accordance with a important aspect, the amount of solder on the underside of the snow guard is controlled so that there is no excess solder running down from the snow guard and ruining the appearance of the expensive metal roof. Preferably, the layer of solder is enough to solder the snow guard without running of the solder from the snow guard down along the metal roof below the snow guard.

In one embodiment, the layer of soldering material is in the form of spaced projections on the underside of the base. When heated the soldering materials flows to cover uneven, that is non-flat surfaces on the underside of the base and/or roof surface to improve the soldering area between the snow guard and the roof. The person doing the soldering will feel that the snow guard shifts or moves relative to the roof as the projections melt and spread the soldering material from the melting projections into the spaces between projections. Usually, this person will sense a sinking downwardly of the snow guard as the projections melt.

In this embodiment, the projections are formed by forcing a paste of soldering material through holes in a plate onto the base of the snow guard. Herein, the projections of soldering materials is a paste solder and flux combined which after application to the base is heated slightly to cause the projections to adhere to the base and the flux to form an outer coating covering the outer surfaces of the projections thereby protecting the underlying solder in the projections. At the time of installation, the crust of flux melts and engages the roof and causes the melting solder to adhere to the roof.

It will be appreciated that the head applied to the snow guard to melt the solder, which melts at about 380°–385° F., will typically be from a torch that will quickly heat the metal snow guard, e.g., a copper snow guard is an excellent heat conductor. In order to prevent the installer from burning his hand holding the snow guard in place on the roof, a forked wooden tool or the like may be used. If it is desired to use a mechanical fastener, e.g., a metal screw, the snow guard may be first fastened in place and then heat applied without the use of a non-conducting head tool. The solder will form around the screw and seal the opening and any interface about the snow guard and screw.

The amount of solder and amount of flux layered on the underside of the snow guard is such that it will not run or wick down the roof. The amount of heat applied is such that the solder merely forms a meniscus at the edge of the snow guard. Also, viewing holes or openings may be provided in the snow guard base so that when applying heat to do the liquidification of the soldering material, the installer may view the formation of the liquid solder to prevent overheating or underheating of the solder, roof material and snow guard material. In one embodiment of the invention, the solder material will be seen to be bubbling in a small viewing hole or holes to allow the installer to ascertain the state of the soldering operation occurring beneath the base of the snow guard.

In one embodiment, the metal snow guard is formed with a flat metal base having an upper layer of metal from a folded metal panel folded over a lower metal panel. An upstanding snow retention member is formed integral with the flat metal base panel. In this embodiment, a plurality of folded upstanding panels form the erected retention members with a central cut-outs or openings at a center juncture or apex of the members to allow water to flow down through the openings and along the lower portion of the base when the snow guard is installed at an incline on an inclined roof. In this embodiment, the preferred upstanding snow retention members have diagonal edges. While the diagonal edges of the upstanding members may have a seam, it is preferred that these diagonal edges be formed by a fold line between adjacent panels in the metal sheet to provide a seamless diagonal edge for the upstanding members.

In accordance with another aspect of the disclosure, the upper viewing hole may be sized smaller in the upper layer of a panel of the base than the larger hole in the lower panel of the base containing the solder paste. The smaller viewing hole may be sized to receive a fastener if it is desired to use a fastener to secure the snow guard to the roof. Of course, if fasteners are used, the snow guard could be made without any solder material in the holes in the lower base. On the other hand, the fasteners can be driven through solder paste and driven into the roof. The preferred solder past may be screen printed onto the underside of the base for a fast and efficient way of applying the solder paste to the base. If desired, to avoid contamination and to seal the solder against oxidizing, a cover sheet may be releasably attached to cover the flux and/or flux solder layer on the snow guard.

Preferably, the folded panels for the snow guard are secured together by a swedging operation of adjacent meal layers although rivets may be used to rivet the layers together.

DETAILED DESCRIPTION OF THE PREFERRED EMBODIMENT

Figure 1A:
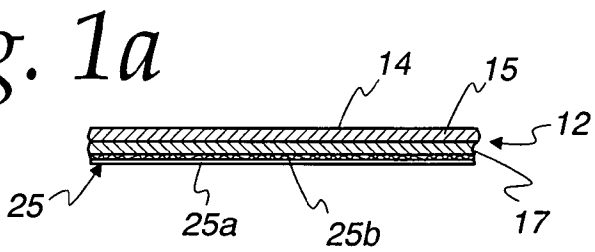
FIG. 1A is a cross-sectional view showing a layer of solder and a layer of flux on the underside of the base of a snow guard.

As shown in the drawings for purposes of illustration, the invention is embodied in a snow guard 10 which is fastened to a downwardly inclined roof or a downwardly inclined portion of building facia, or the like to restrain ice and/or snow from sliding downwardly onto people, automobiles, or the like. For the sake of convenience, the term "roof" shall be used generally to mean not only a roof but also an inclined surface of a facia, covered walkway structure, or whatever the snow guard is fastened to. The snow guard has a base 12 that is fastened to the inclined roof and includes upstanding members 20 projecting upwardly from the base and for engaging the ice or snow accumulated on the roof. The roof may be made of various materials and shapes. Typically, the metal roof formed of a series of adjacent metal sections or panels that have upwardly projecting side edges flanges that are overlapped to form a seam between adjacent panels. In this type of roof, the metal sections have a fixed width, e.g., 9–24 inches with 12 inches being typical between their respective side edge flanges 18. In the length, the panels often extend quite a long way, e.g., 10–40 feet in length.

The sun heats the metal roof sections and the snow or ice between the seams tends to form, at times, into long sheets that slide down metal roofs. Sometimes, sheets as long as six feet in length may project over the roof's edge. The snow guard is intended to hold the ice and snow sheet against sliding off the roof in a big sheet or from hanging over the roofs edge and then dropping onto and damaging people and property.

The snow guard 10 illustrated in FIGS. 1–11 has a medallion-like appearance that is highly functional and yet is aesthetically appearing with a base 12 from which a plurality of upstanding members 20 radiate upwardly and inwardly to a central apex at a central vertical axis 22 for the snow guard. The present invention is not limited to any particular metal snow guard design; another embodiment of a metal snow guard is shown in FIGS. 12–18. The snow guard illustrated in FIGS. 1–11 has a square base 12 that can be installed at any 360□ angular orientation and function equally as well. Unlike other conventional snow guards that should be installed in one orientation and sometimes are incorrectly installed with the wrong side facing up slope to engage and hold the snow and ice load, the preferred snow guard is relatively foolproof in installation in that there is no particular side that is to be facing up slope or down slope. The square base has an additional advantage in that when its side edges 26 are parallel to the roof panel flanges, the effective width is equal to the width of one side of the square; and, when it is desired to have a wider width for fitting between roof panel flanges spaced farther apart, the square base may be rotated 45□. to increase the effective width by about 40% when a corner 28 of the base is facing up slope and another corner is facing down slope, as shown in the aforesaid patents.

In accordance one embodiment, the snow guard 10 is made from a folded sheet of metal with the base 12 formed by folding a stamped metal sheet 14 (FIG. 2) to form the base 10 with superimposed upper layer or panel 15 and a lower layer or panel 17, and folding the stamped metal 12 along diagonal lines to form diagonally extending edges 16 on the upstanding members 20, and aligning center holes or openings 22 in the stamped sheet to form a central opening 23 located at the center axis of the upstanding members at the center of the base. The opening 23 allows water to flow across the uphill portion of the base through the central opening 23 and down across the lower portion of the base. The appearance of the diagonal edges of the upstanding members is enhanced in the preferred embodiment of the invention by having only a folded edge between a vertical panel 20*a* and a second adjacent vertical panel 20*b* (FIG. 7) that comprise each of the upstanding members 20, there being four upstanding members in the embodiment shown in FIG. 1.

In accordance with another important aspect, there is a new and improved method of soldering a metal snow guard of almost any kind to a metal roof. This is achieved by providing the snow guard with a layer of solid soldering material 25 (FIGS. 1A, 1B, 7 and 9) on the underside of the base 10 such that by the application of heat to the upper side of the base as by heat from a torch. The solid soldering material at area 27 on the base will liquify and solder the base to the roof.

In the preferred embodiment, the soldering material 25 comprises a flux layer 25*a* that is used to wet the underlying surface of the metal base to cause the adhering of a solder layer 25*b* to the base. The solder layer 25*b* is a thin layer either laid in a pattern at special locations, or preferably as illustrated in FIG. 1A a layer extending substantially or completely across the base from about one edge to an opposite edge of the base. The thickness of the solder layer 25*b* is controlled so that the amount of liquid solder when heated will firmly secure the base to the metal roof without an excess of solder flowing down the roof and marring the same. Preferably, the liquid solder will only form a meniscus about the edge of the base and will not flow any further.

In this preferred embodiment, a solid layer 25*a* of flux is laid across the solder layer 25*b* and performs the dual functions of sealing the solder layer 25*b* from air that will oxidize the lead in the solder and thereby interfere with a good soldering interface between the solder and the underlying metal roof. The amount of flux, including the thickness of the flux layer 25*a*, is controlled such that the roof metal will be wetted to receive the liquid solder to form a good solder connection between the snow guard base 10 and the roof without flux and/or solder flowing down along the roof.

In a preferred embodiment, the layer of soldering material (25) is formed with projections 29 (FIG. 1B) of solder crusted with flux on the underside of the base. When the base 12 is placed in the metal roof, the projections 29 or bumps begin to melt and spread laterally to cover any uneven surfaces on the base and/or roof. In the preferred embodiment, as these projections 29 melt and spread laterally the snow guard actually lowers slightly as the projections flatten and flow to fill the spaces between projections. The flux coating on the projections also melts onto the roof and prepares it to accept the solder. By way of example only, the projections 29 may be about 0.0625 inch in height and about 0.250 inch in diameter. The nine projections 29 illustrated in FIGS. 13–23 are spaced about 0.375 to 0.500 inch apart. The projections may be formed by squeezing a paste of solder and flux through a plate having 0.250 diameter holes onto the underside of the snow guard base. The base is then heated slightly to cause the solder to become molten and to cause the flux to become molten and form a crust of flux 25*a* on the outer side of the projections of solder 25*b* underlying the crust. The flux crust 25*a* forms an outer layer of flux with the solder 25*b* therebeneath covered by the flux and protected thereby. The former paste becomes a solid layer of solder and flux providing a surface that is rough to the touch. That is, the projections 29 (FIG. 1B) may be actually felt as a rough surface rather than a smooth surface. Of course, after application, the solder material of the projections will have melted and flowed so that there is no longer any rough surface. The spaced projections of solder material 25 may be used any or all of the snow guard embodiments herein disclosed. The melted projections assist in securing folded panels on the base that may not be flat across the entire base because of the way the base is made or the base is made of several folded panels or because the roof metal itself is not flat. The flowing of the flux and solder from the projections tend to result in a larger area of good soldering when surfaces are uneven.

The use of a solid flux layer 25*a* laid on the underside of the metal snow guard base 10 works with metals such as copper sheet with the snow guard being made substantially entirely of copper. If the snow guard is made of lead or zinc, then a very aggressive flux should be used and this aggressive flux may be provided separately from the solder layer 25*b*, that is without there being a flux layer 25*a* covering the solder layer. For example, a tube of paste flux of the aggressive kind may be provided in lieu of the preapplied layer 25*a*. After abrading the metal roof surface, as with a rough surface pad, the paste is applied as a coat onto the cleaned surface or to the flux layer 25*a* on the underside of the metal base.

Figure 1B:
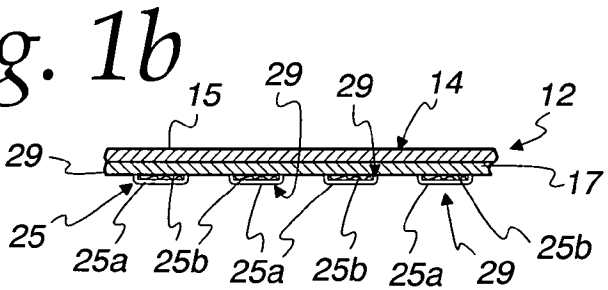
FIG. 1B is a cross-sectional view showing spaced projections of solder and flux on the underside of the base of a snow guard in accordance with another embodiment of the invention.
Figure 1C:
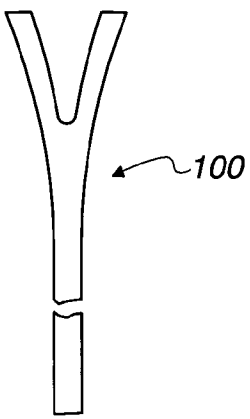
FIG. 1C is a perspective view of a tool used to hold the snow guard while it is hot.
Figure 1:
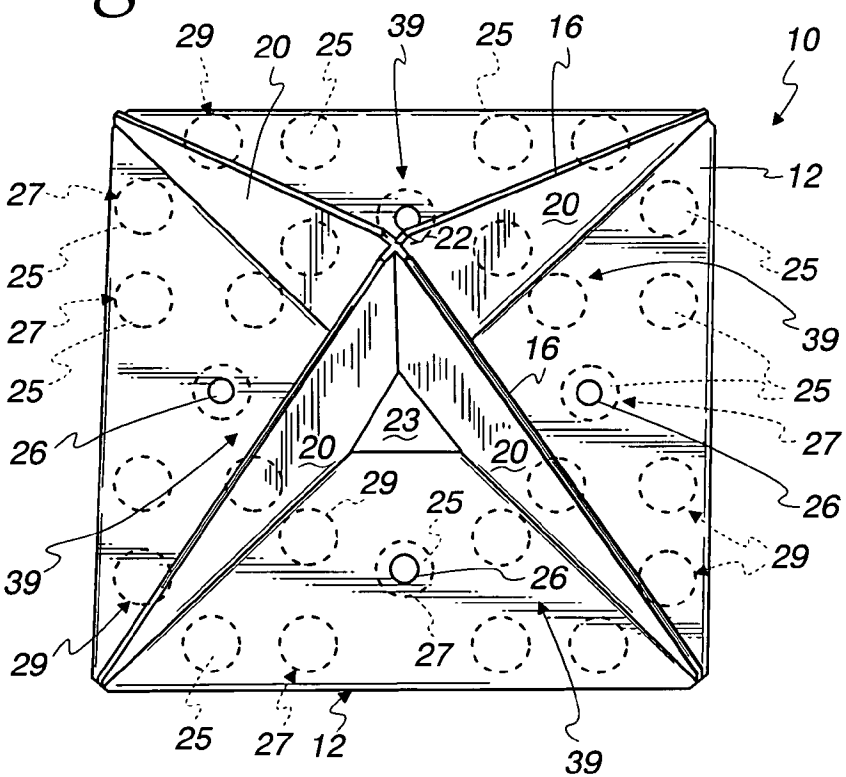
FIG. 1 is a perspective view of a metal snow guard constructed in accordance with and embodying the invention.

With a suitable heat source such as a torch, the upper side of the metal base is heated to melt the flux and the solder, the solder typically melts at 380°–385° F. Because the metal snow guard is such a good heat conductor, it is preferred to hold the snow guard in place by a tool, such as a fork or splined wooden tool 100 (FIG. 1*c*). Manifestly, any tool that will not burn the fingers of the installer may be used rather than this illustrated tool. Typically, the torch will heat the metal snow guard base to about 500°–600° F. Such that the solder and flux are melted and are free flowing. The metal roof under the snow guard will also be heated. After soldering, the heat is removed and the liquid solder will solidify to form the solder connection between the snow guard and the roof.

The aggressive solder should be used for soldering snow guards made of zinc, lead, lead coated steel, etc. The use of the preprinted 25*a* of flux or the separate application of a flux that is not layered and stored with the snow guard depends on a number of factors that vary depending on the snow guard construction, its size, shape and material as well as the roof material. The above descriptions are merely illustrative and are not limiting.

The time of heat application may also be varied. In some instances, the liquidification of the solder may be felt when the projections 29 melt and the snow guard lowers; and in other instances the liquid solder may be seen through viewing holes 30 in the base. In other instances, the solder viewing through the holes 30 may be difficult and the applicator may view a solder meniscus forming at the edge of the base plate and discontinue heating the snow guard. In other instances, the time of heat application may be given along with the installation instructions. With the proper amount of solder, flux and heat application, the difficult task of soldering may be accomplished.

Figure 2:
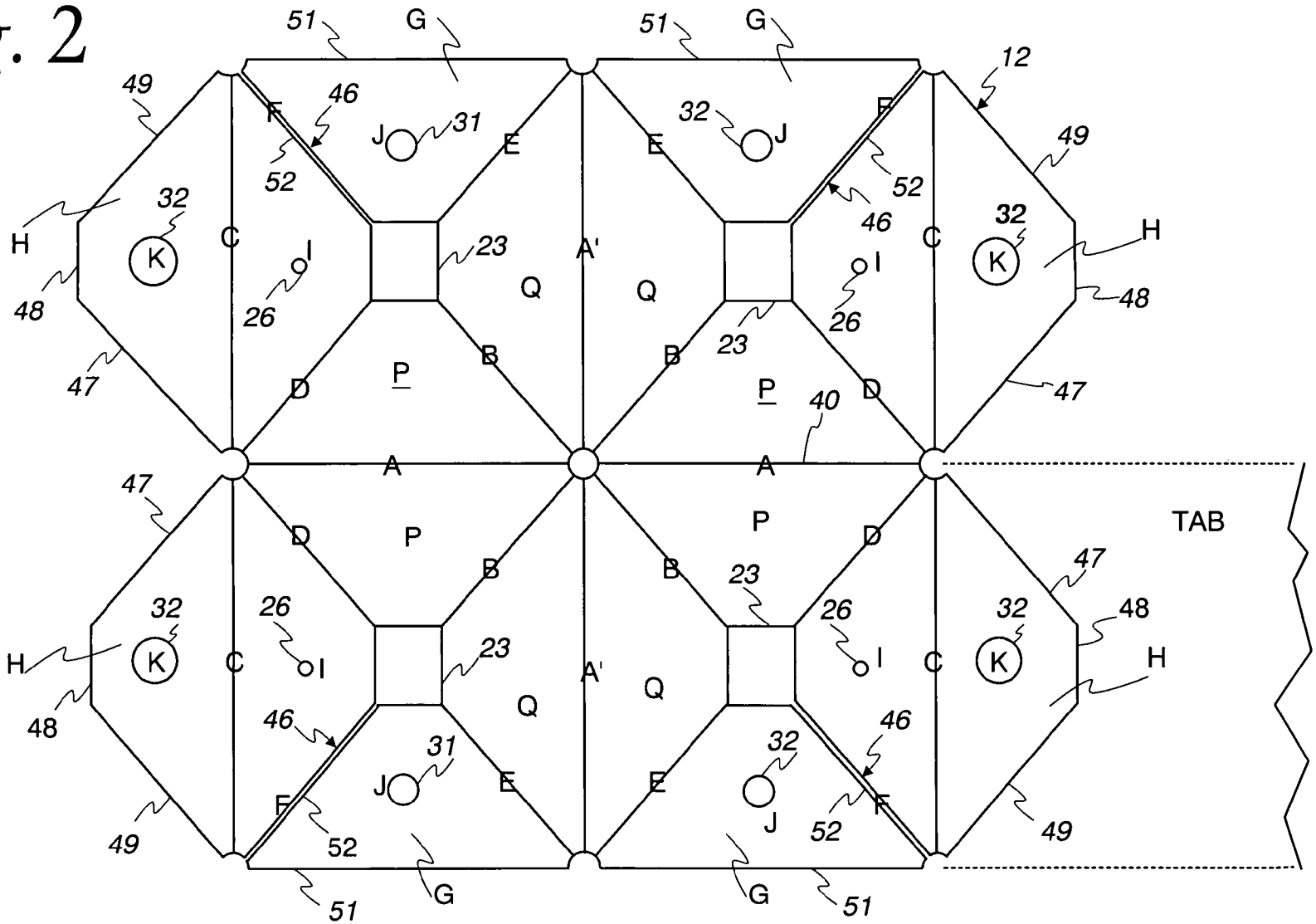
FIG. 2 is a sheet metal blank stamped from a sheet of metal prior to bending and folding to form the snow guard of FIG. 1.
Figure 4:
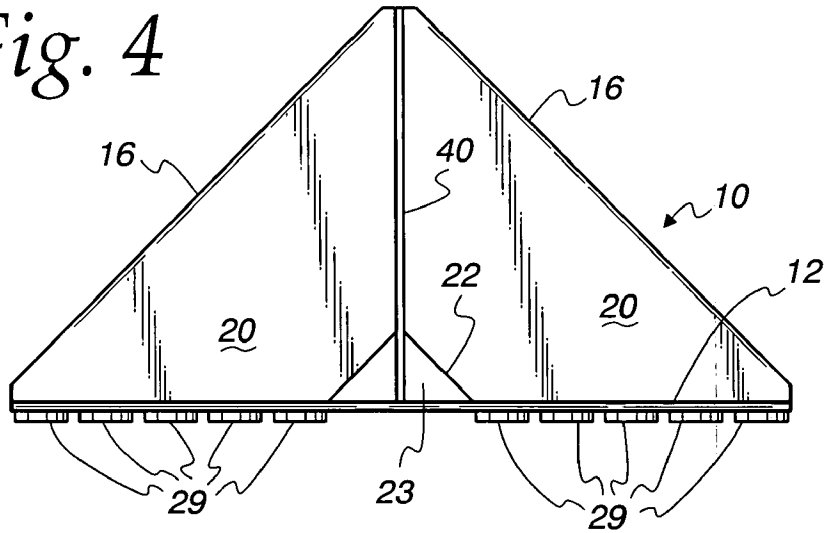
FIG. 4 is a front elevational view of the snow guard.
Figure 5:
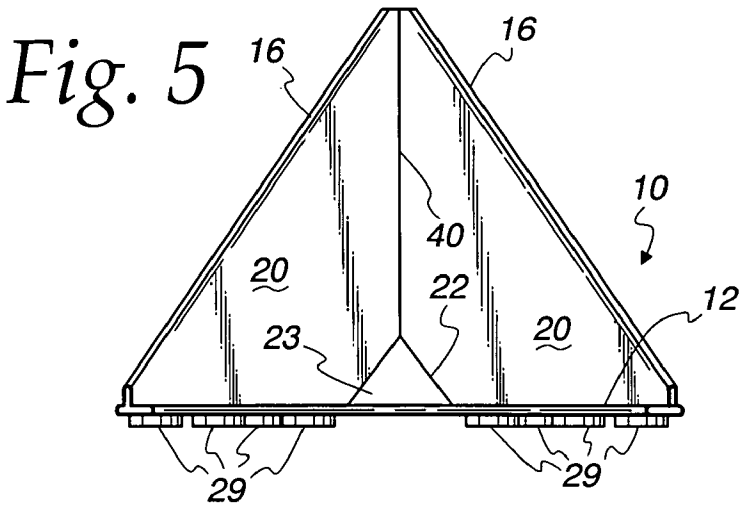
FIG. 5 is a side elevational view of the snow guard.
Figure 3:
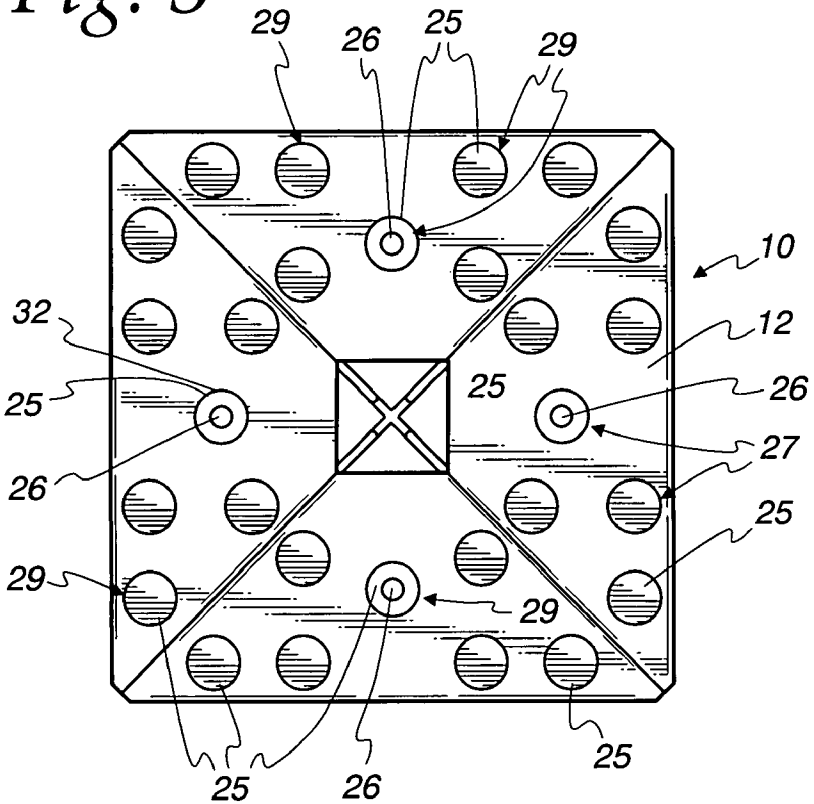
FIG. 3 is a view of the underside of the base of the snow guard of FIG. 1 having spaced areas of soldering material on the base.
Figure 6:
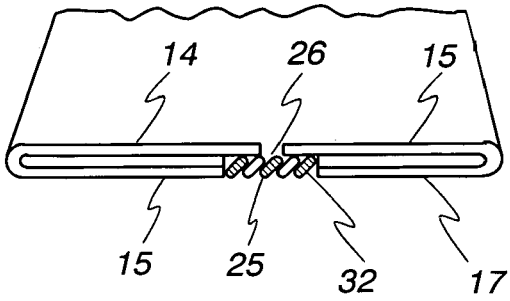
FIG. 6 is an enlarged sectional view of the base showing a small view hole in an upper panel or layer of the base and with a solid solder material in a hole in a lower panel or layer of the base.
Figure 7:
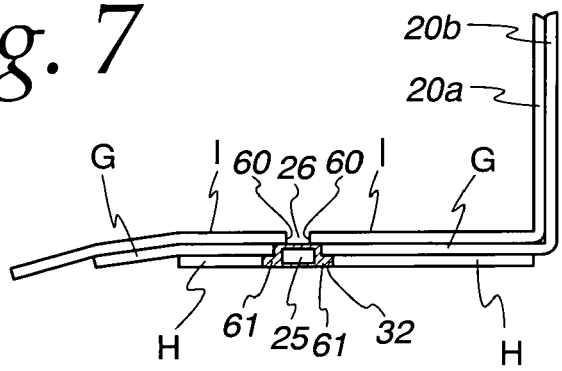
FIG. 7 illustrates swedging of material from the upper and intermediate layers into the holes to assist in holding the snow guard panels tightly together.
Figure 8:
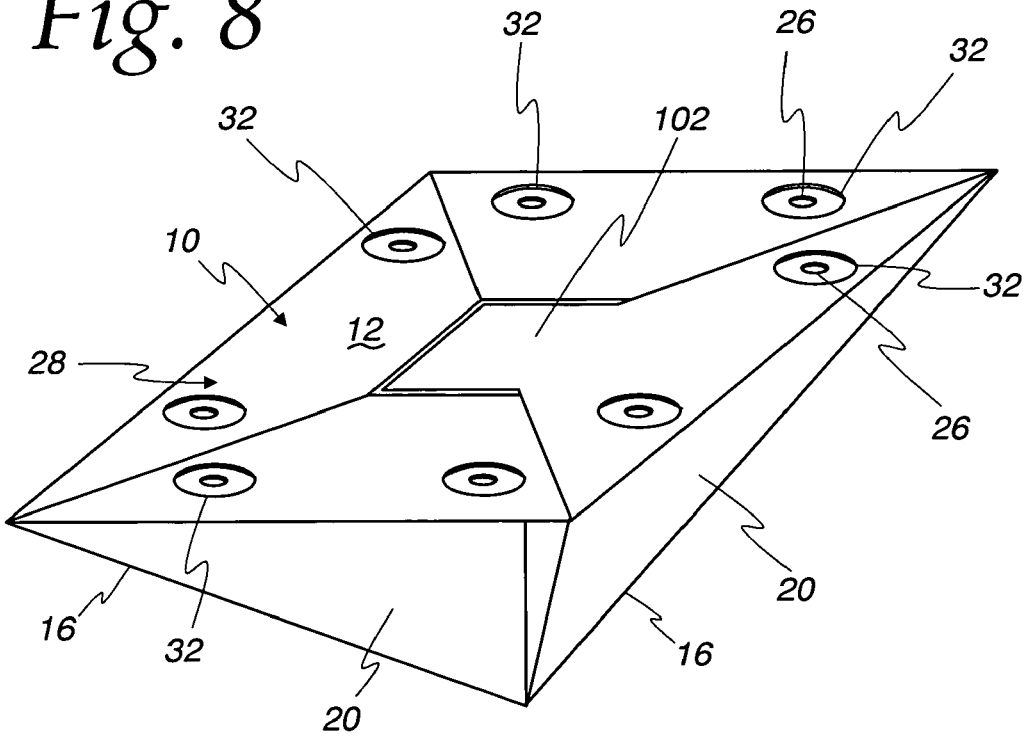
FIG. 8 is a bottom perspective of a second embodiment of the invention.

In the embodiment shown in FIGS. 7 and 8, the viewing holes 30 are located over the soldering material 25 which is in the form of spaced areas 27 of solid material contained in holes 32 in the bottom layer 17 of the base. In the embodiment of FIG. 2, the metal sheet 12 has viewing holes 30 formed in the panels I and the solder receiving holes 32 in panels H with an intermediate panel G also having a hole 33 therein which is aligned with the holes 25 and 32, as shown in FIG. 6 when the sheet has been folded into the snow guards shape shown in FIGS. 1,4 and 5.

In accordance with a still further embodiment of the invention illustrated in FIG. 1A, the bottom layer 17 of the base is tinned with a coating of solder across the entire surface of the base. In such instances, there will still be viewing holes in both the upper layer 15 and the lower layer 17 of the base to allow viewing of the liquidification of the soldering material and the soldering operation with solder bubbling in the holes. The tinned solder coat may be applied by dipping the base into a solder both, by screening printing, painting, etc.

For a copper metal snow guard, one method of forming the solid solder layer 25*b* is to apply a powder of flux and solder on the base 10 and add to heat the base to cause the powders to liquify and then allow the solder to solidify. Alternatively, the solder layer 25*b* may be formed by applying flux to the underside of the metal base and dipping it in another solder bath. After application of the solder layer 25*b*, it is cleaned and rinsed off. Then a liquified flux layer 25 is applied over the solder layer 25*b* and is dried to cover and seal the solder layer. Other methods may be used to form the solder layer and/or flux layer such as squeezing a paste of solder and/or flux through openings to form the projections 29.

Figure 8A:
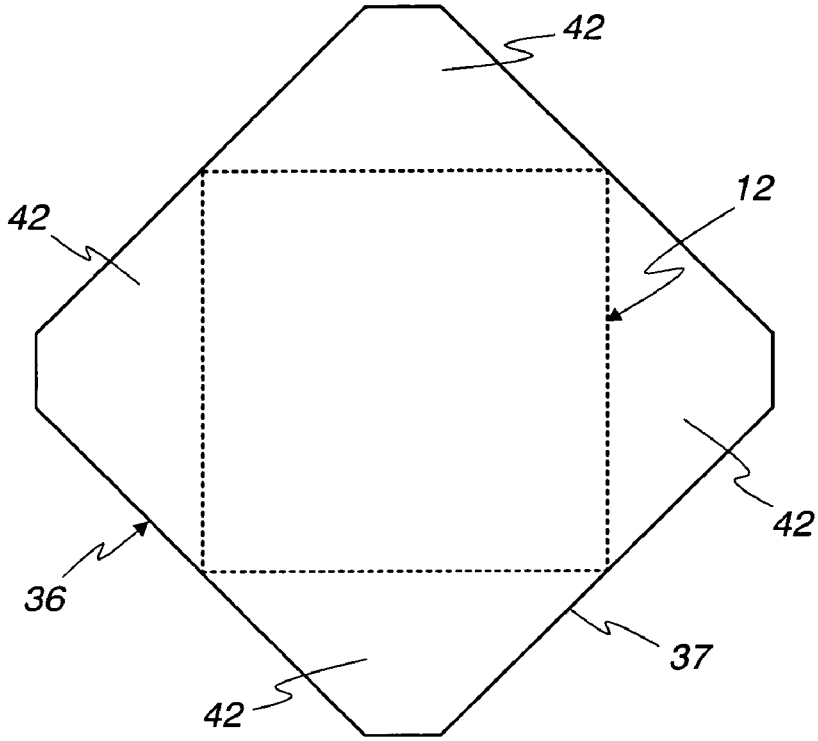
FIG. 8A is a plan view of a tape having an adhesive coating to releasably secure the tape to the snow guard to cover and protect the soldering material.

In accordance with another aspect, the soldering material 25 may be prevented from being contaminated by a cover 36 (FIG. 8A) in the form of a releasably adhered sheet or tape 37 that may be pulled by the installer at the time of installation from the snow guard base to uncover the soldering material. Herein, the cover sheet 37 is a large piece of plastic that covers the entire base 12 of the snow guard and has corner sections 42 that are folded up over the edges of the base and into aligned compartments 44 between the adjacent upstanding members to cover the one or more viewing holes 30 in the top layer 15 of the base 12. Thus, the soldering material may be covered to protect the same from contamination, drying out, and/or detachment from the base.

Typically, the snow guards are shipped to the point of installation and may be kept in inventory for months before being applied. Also, the construction site and/or roof may be dirty and could contaminate an unprotected flux layer 25*a* or solder layer 25*b* where no flux layer 25*a* is present to cover the solder layer. Manifestly, the use of a cover 37 is optional.

Referring now in greater detail to the embodiment of FIGS. 1–11, in this snow guard the upstanding members 20 are triangular in shape with lower ends 38 integrally formed with the base plate. Each pair of upstanding members is aligned along a diagonal of the square base with the outermost and lowest ends of their diagonal side edges 34 meeting at the corners 28 of the base. The diagonal side edges 16 are, in effect, hypotenuses of each of the triangular-shaped upstanding members. The inner vertical sides 40 of the triangular-shaped upstanding members are abutted back-to-back to form a central post at the vertical axis 22 of snow guard. The illustrated height of the upstanding members is 3.00 inches; and with a 0.19 inch thick base, the total height is 3.19 inches.

The four upstanding members 20 create the spaces or chambers 39 between each pair of adjacent members into which ice or snow may be collected. The ice or snow in the chambers or pockets between the upstanding members holds the same against sliding down the roof surface. To allow rain water or water from melting ice to flow through the snow guard, the center of the snow guard is formed with four openings 23, one opening being formed in each of the upstanding members 20 adjacent the center axis of the snow guard. Herein, each of the upstanding members 20 is generally triangular in shape except for a small lower inner corner that has been cut off along a diagonal line 40 (FIG. 1) to form the opening 23.

Referring now to the preferred blank or metal sheet 14 (FIG. 2) from which the snow guard is formed, it is symmetrical about a horizontal center line or axis A and a vertical axis or center line A'. The stamped sheet 14 is formed with four diagonal extending slots 46 extending from the outer edges of the blanks to each of the four center openings 23 which are located at the center axis 22 of the snow guard when it is formed. The four panels H each having a solder receiving hole 32 therein are located at opposite left and right ends of the blank sheet 14 and generally trapezoidal in shape. The panels H have inclined sides 47 extending from the horizontal center line A to an outer vertically disposed edge 38 and a reversely inclined edge 49.

The blank 13 is preferably creased with a fold line at the respective horizontal center line A and also with a fold line at the vertical center Line A' in order to form four panel sections which are identical or mirror images of one another. The first bending operation will be to bend at 30 the four trapezoidal shaped panels H to start to form the bottom layer 17 of the base by bending at about each fold line C between each respective panel H and an adjacent panel I which will form the upper layer 15 of the base having the viewing holes 26 therein. In the next forming operation, each of D fold lines between panels I and panels P is bent up to about 95° between the respective panels I and P. Then, the four panels Q, which are to be vertical sides of the upstanding members 20 are bent upwardly at 90° about fold lines E which are between the panels Q and adjacent intermediate panels G. Then, the center axis fold lines A, A' and B are all bent upwardly toward the central vertical axis 22 to form the four upstanding members 20 with the two upper panels Q, Q being back-to-back to form a first upstanding member 20 that is aligned with another second upstanding member 20 formed from the two lower panels Q, Q of the blank when they are back-to-back in the upright position.

The tip F of the intermediate channel G is pivoted out until aligned with its associated fold line C as the panels Q, Q and Q, Q are bent upwardly to form the upstanding members 20. Next, the four, bottom layer panels H are bent the full 180° about fold lines C to form the bottom layer 17 of the snow guard. In the fully assembled snow guard, each edge 51 of the intermediate panel G will be located adjacent the juncture of upstanding panel P and an adjacent horizontal panel I of the base at the fold line D therebetween. Each free edge 52 of upper layer panel I will be adjacent to and/or abutting a vertical side panel Q of the upstanding member when the snow guard is fully erected.

It is preferred to make the assembled snow guard more secure against panel separation during shipping, handling, installing, etc. by interlocking pieces of the panels together. An inexpensive and preferred manner of interlocking is to use a pointed swedging tool (not shown) through the aligned holes 26, 31 and 32, as best seen in FIG. 7, and bending down material 60 from the overhead panel I down into the intermediate hole 31 to prevent sliding of the upper panel I along the panels G. Likewise, material 61 of the intermediate panel G is bent by swedging down into the hole 32 in the panel H to limit the panels G and H from sliding relative to one another.

In this above described embodiment of the invention, the bottom of the base has an opening or cavity 65 through which the roof could be viewed. It is preferred to fill the cavity 65 (FIG. 3) with a square cavity piece 66 of metal sized to fill the cavity and preferably adhered within the cavity. If the sheet metal of the snow guard has a colored coating on one side, then the cavity filler piece 66 will have its colored side facing upwardly to be viewed through the central opening 23 at the center axis of the snow guard. In other embodiments of the invention described hereinafter there is no center cavity and no filler cavity piece 66 to be used.

Figure 9:
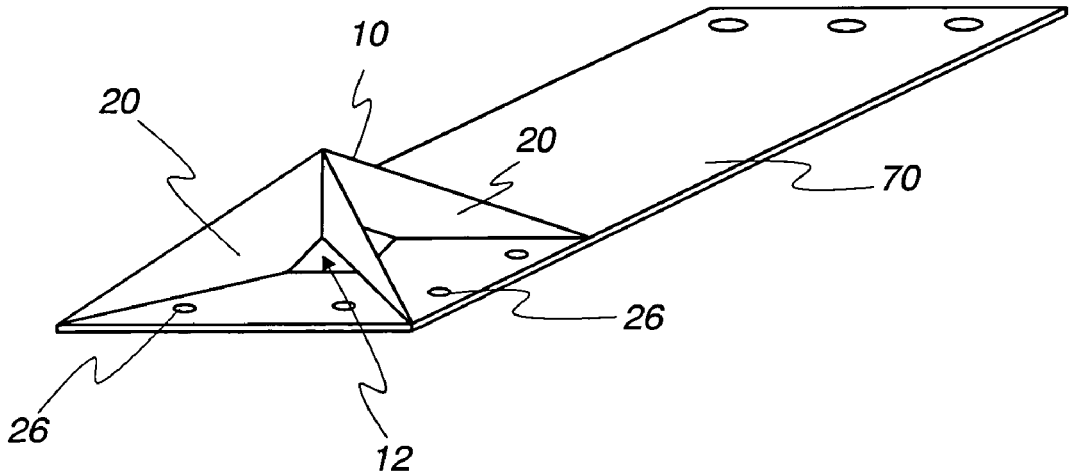
FIG. 9 illustrates another embodiment of the invention having an integral tab to secure the snow guard to a shingled roof.
Figure 10:
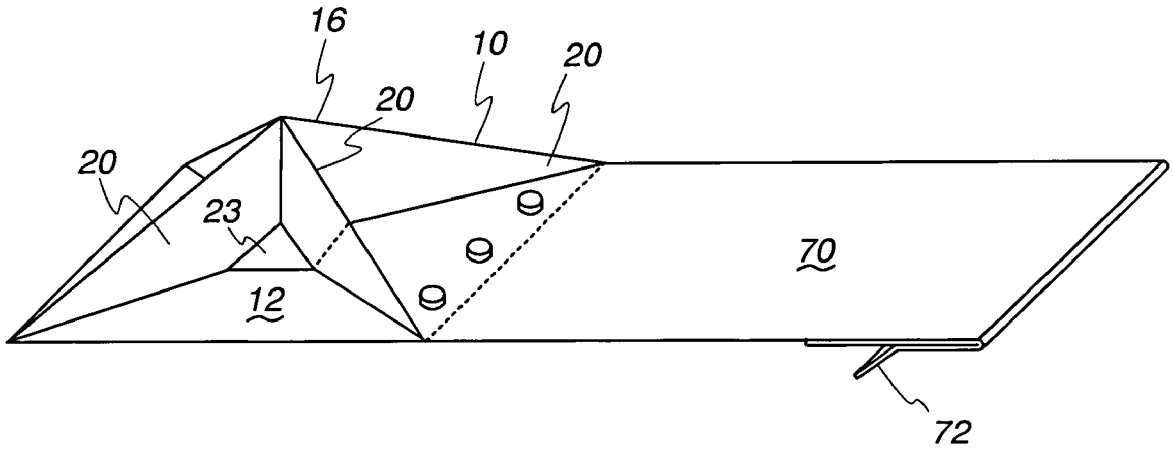
FIG. 10 illustrates still another embodiment of the invention having an extension tab projecting outwardly from the base to be fastened to the roof.

In many instances, it is preferred to provide an extension tab 70 that is extended up under a shingle, as shown, for the long tab 70 in FIG. 9. For slate roofs, the tab 70 is often formed with a downwardly extending hooked end 72 (FIG. 10).

For those snow guards 10 having solder material 25 in the holes 26, 31 and 32, the top and bottom of the holes are covered by tape (FIG. 8A) as above described to complete the formation of the snow guard. When it is desired to use the snow guard for roofs where solder is not available, then screws, nails or mechanical fasteners may be inserted through the aligned holes 26, 31 and 32 to fasten the snow guard to the roof.

Figure 11:
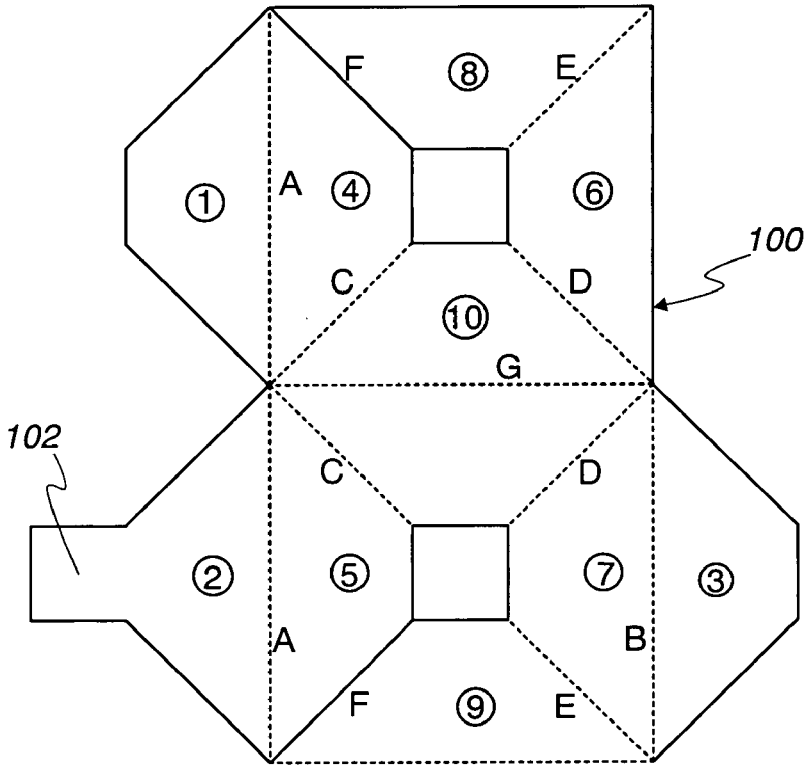
FIG. 11 is a view of a stamped metal sheet to be erected into a further embodiment, which is shown in FIG. 8.

In another embodiment of the invention, a blank 100 (FIG. 11) is stamped from a metal sheet and is provided with a bottom elongated tab 102 which will be folded to provide an integral cavity covering piece 102 rather than the separate cavity covering piece 66 above described for the first embodiment of the invention. In the embodiment shown in FIG. 11, there is no intermediate layer in the base which is formed only of two superimposed panels rather than these panels as in the first embodiment of the invention. A bottom view of the snow guard of FIG. 11 is shown in FIG. 8 with tab 102 disposed to cover the center cavity. Preferably, the base shown in FIG. 8 has two holes 32 in each of the four bottom sections of the base and two view holes 26 in each of the four sections of the base to provide eight soldering areas or spots to solder the otherwise fasten the snow guard to the roof.

The formation of the snow guard shown in FIG. 8 from the bank of FIG. 11 uses the following bending/forming procedure:

Bending/Forming Procedure

1) Bend tabs 1, 2 and 3 down 90° along lines "A" and "B," respectively;
2) Bend tabs 4 and 5 90° upward along "C" lines;
3) Bend tabs 6 and 7 90° upward along "D" lines holding center portion No. 10 flat along center line "G;"
4) Bend tabs 8 and 90° inward along "E" lines to form pyramid shape with "F" edge and "C" line meeting. No. 8 tab will be under No. 4 tab and No. 9 tab will be under No. 5 tab;
5) Fold center portion No. 10 180° downward along "G" line;
6) Fold two tabs 1 and 2 over an additional 90° to complete the base of unit and capture 8 and 9 tax; and
7) Mate two units on surfaces 6 and 7 and fold two tabs No. 3 over an additional 90° to clamp units together.

Figure 12:
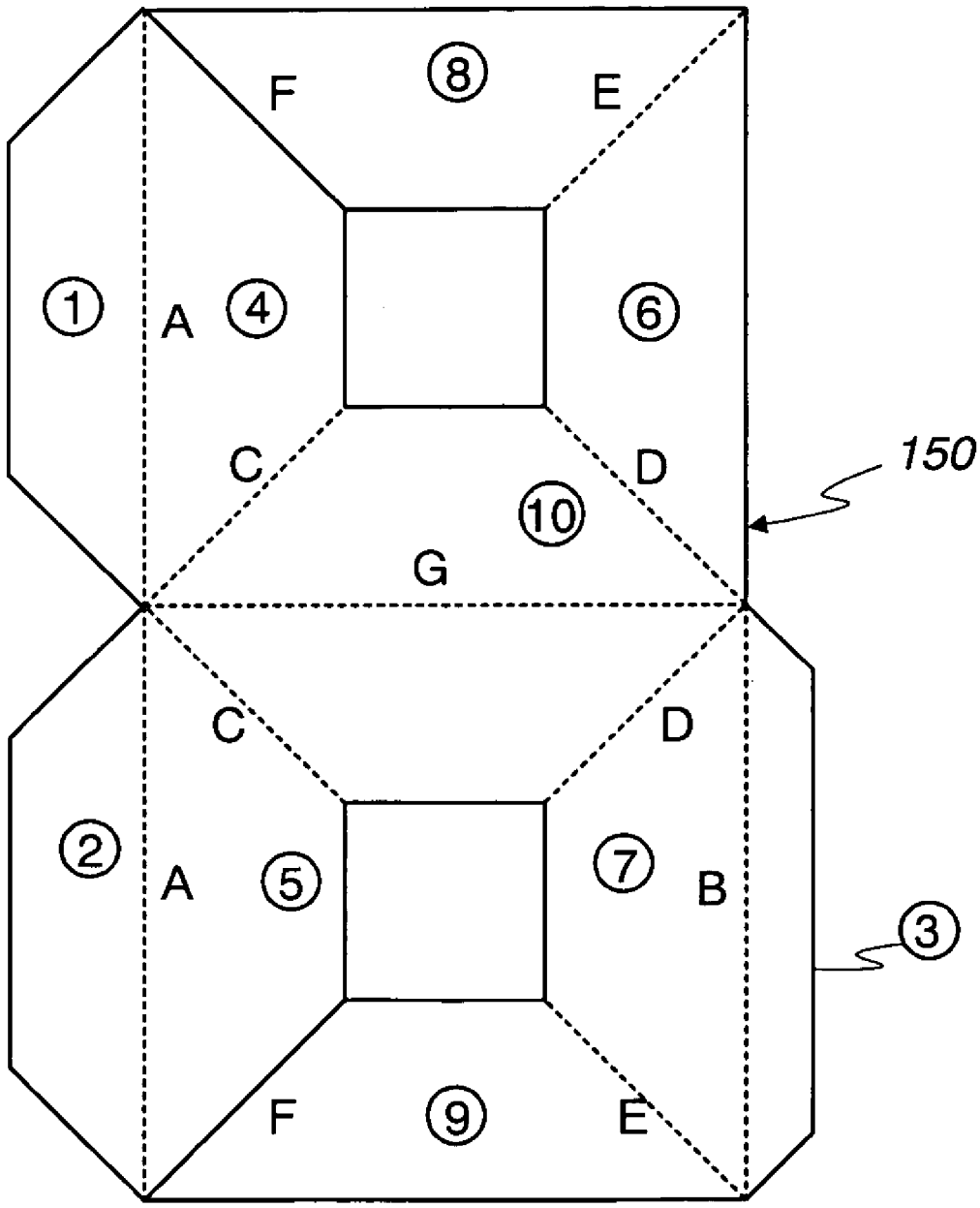
FIG. 12 is a stamped metal sheet to be erected into one-half of a snow guard and joined to a second half formed from a second metal sheet stamped for a still another embodiment of the invention.
Figure 13:
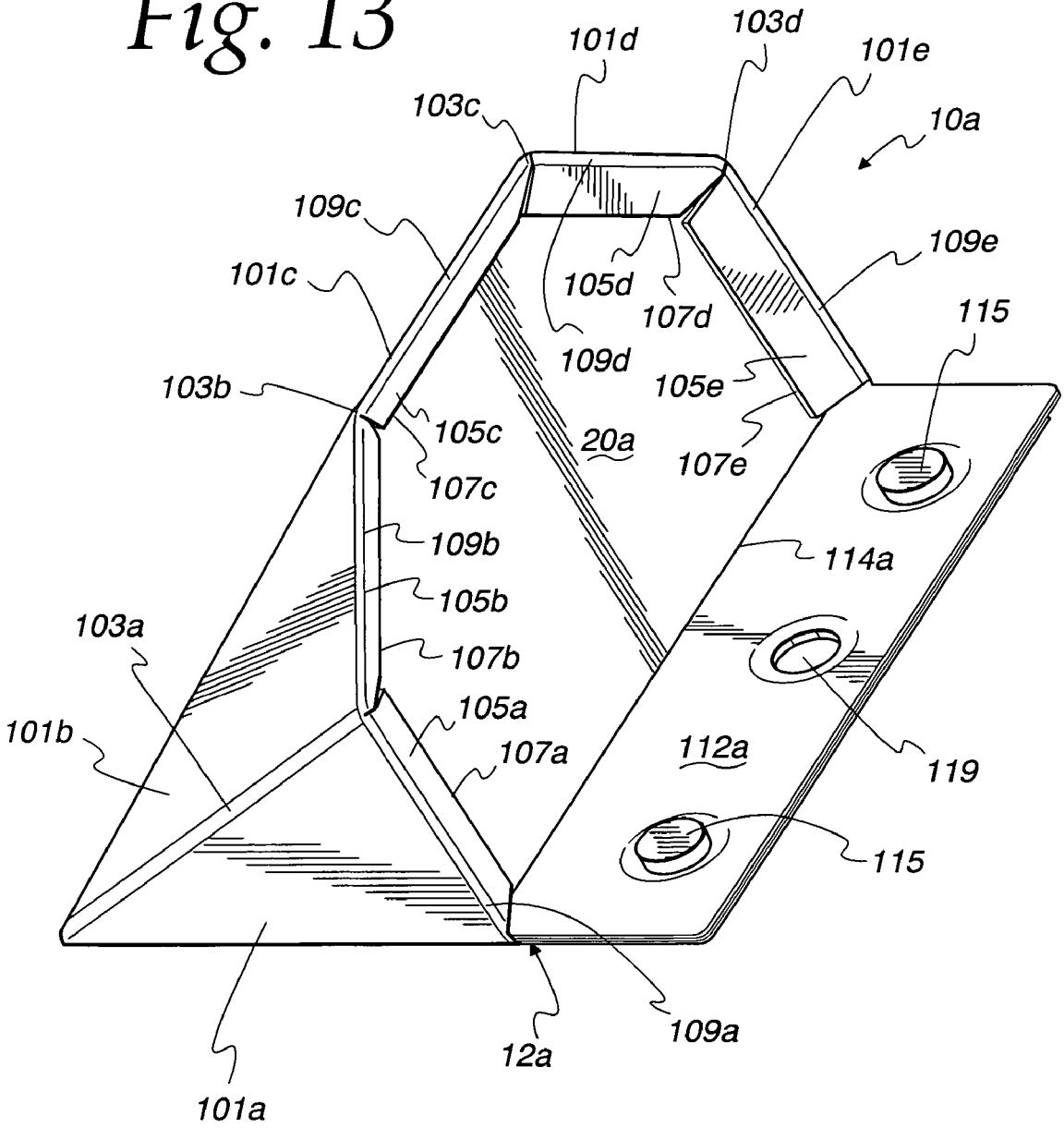
FIG. 13 is a perspective view of a snow guard constructed in accordance with a further embodiment.
Figure 14:
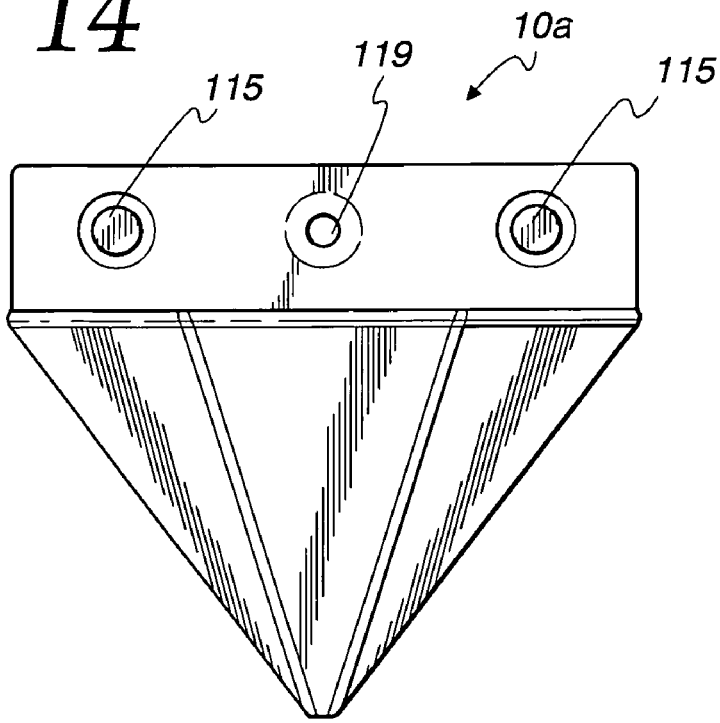
FIG. 14 is a plan view of the snow guard of FIG. 13.
Figure 15:
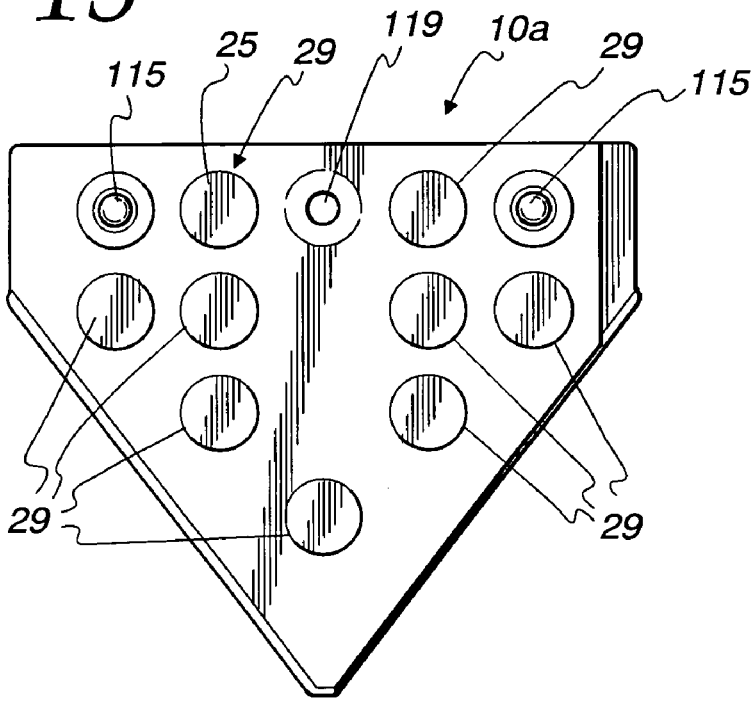
FIG. 15 is a bottom view of the snow guard of FIG. 13.
Figure 16:
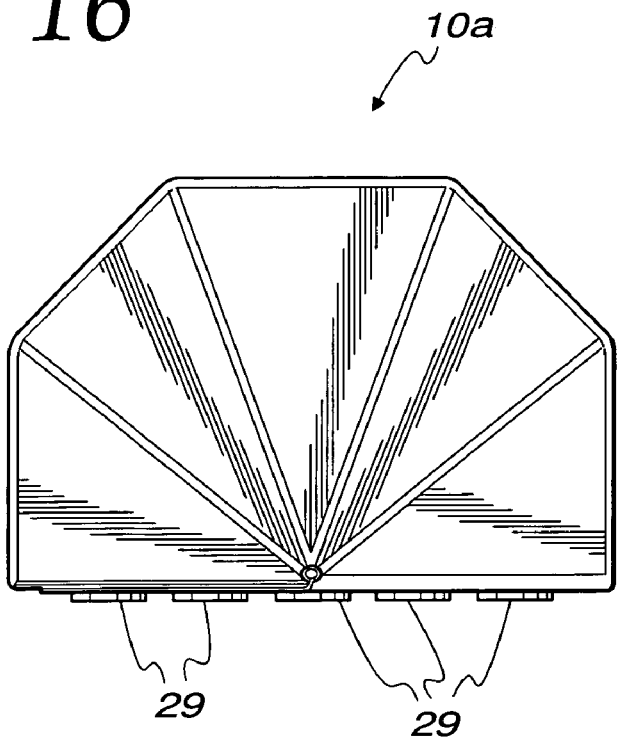
FIG. 16 is a front elevational view of the snow guard of FIG. 13.
Figure 17:
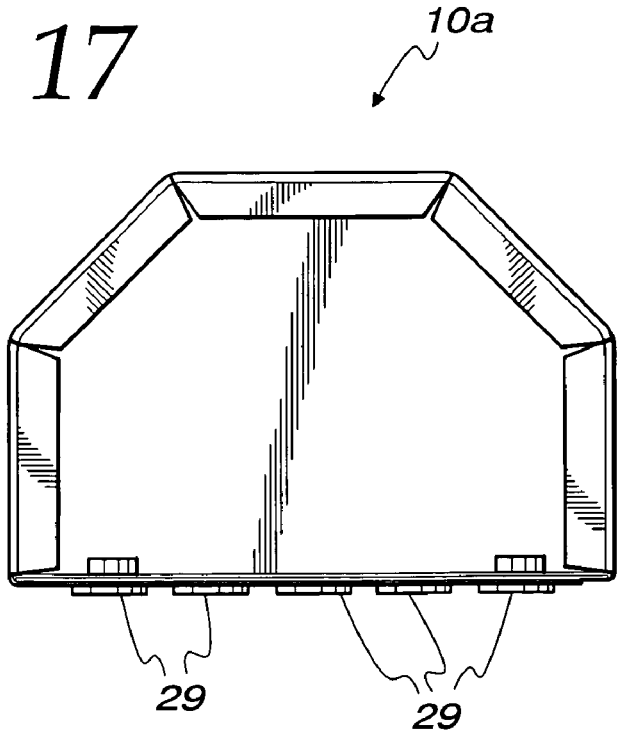
FIG. 17 is a rear elevational view of the snow guard of FIG. 13.

A still further embodiment of the invention is shown in FIG. 12 where a stamped blank 150 for one-half of the snow guard is to be formed from the illustrated blank and a second half of the snow guard is to be formed with an identical second blank, which is not shown in FIG. 12. The two halves are identical and they are mated and secured together to form a unitary snow guard 10. The viewing holes 26 and solder containing holes 32 are not illustrated (FIG. 12), but obviously may be provided therein.

The preferred bending/forming procedure for this FIG. 12 embodiment is as follows:

1) Bend tabs 1, 2 and 3 down 90° along lines "A" and "B," respectively;
2) Bend tabs 4 and 5 90° upward along "C" lines;
3) Bend tabs 6 and 7 90° upward along "D" lines holding center portion No. 10 flat along center line "G;"
4) Bend tabs 8 and 90° inward along "E" lines to form pyramid shape with "F" edge and "C" line meeting. No. 8 tab will be under No. 4 tab and No. 9 tab will be under No. 5 tab;
5) Fold center portion No. 10 180° downward along "G" line;
6) Fold two tabs 1 and 2 over an additional 90° to complete the base of unit and capture 8 and 9 tax; and
7) Mate two units on surfaces 6 and 7 and fold two tabs No. 3 over an additional 90° to clamp units together.

When using tape style mounting, insert 1.50" square into center of base from bottom side to fill hole.

Figure 18:
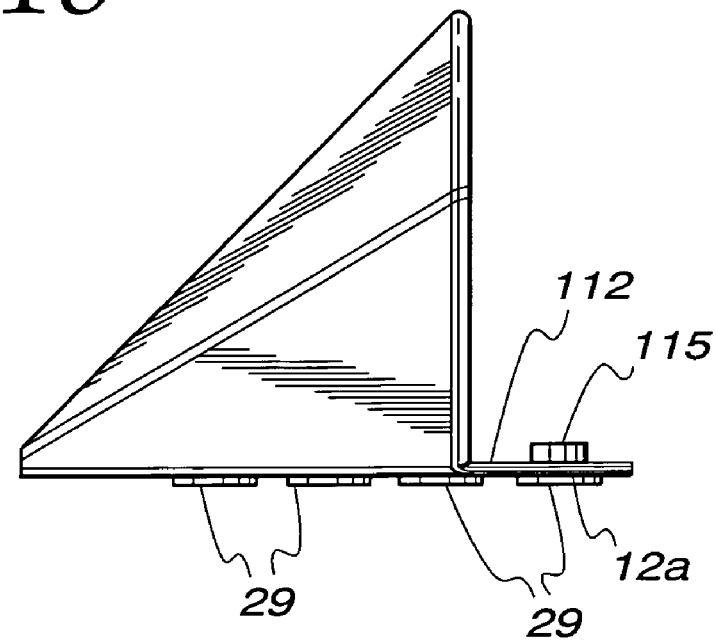
FIG. 18 is a left side view of the snow guard of FIG. 13.
Figure 19:
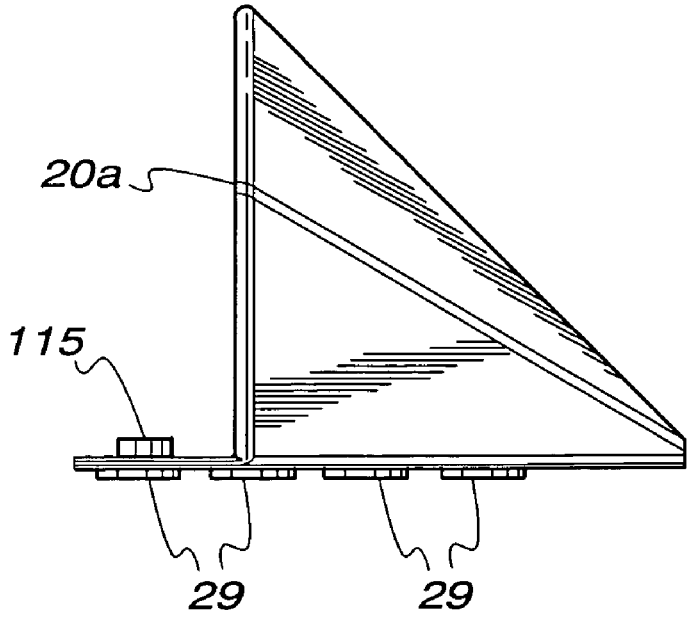
FIG. 19 is a right side view of the snow guard of FIG. 13.
Figure 20:
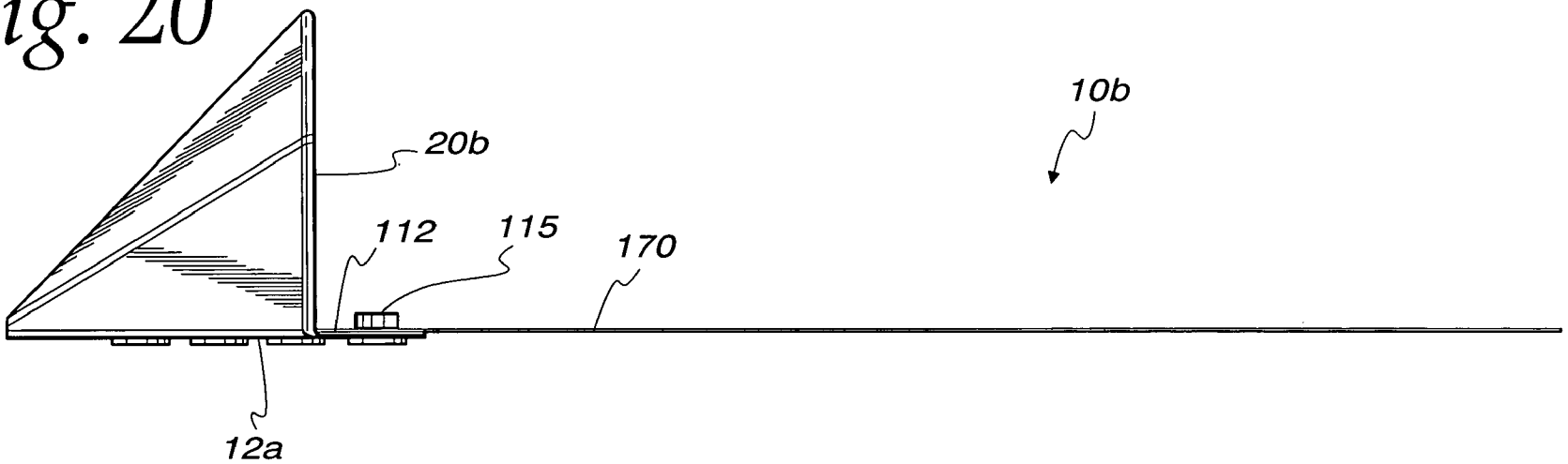
FIG. 20 is a side elevational view of another embodiment of a snow guard with an elongated attaching tab.
Figure 21:
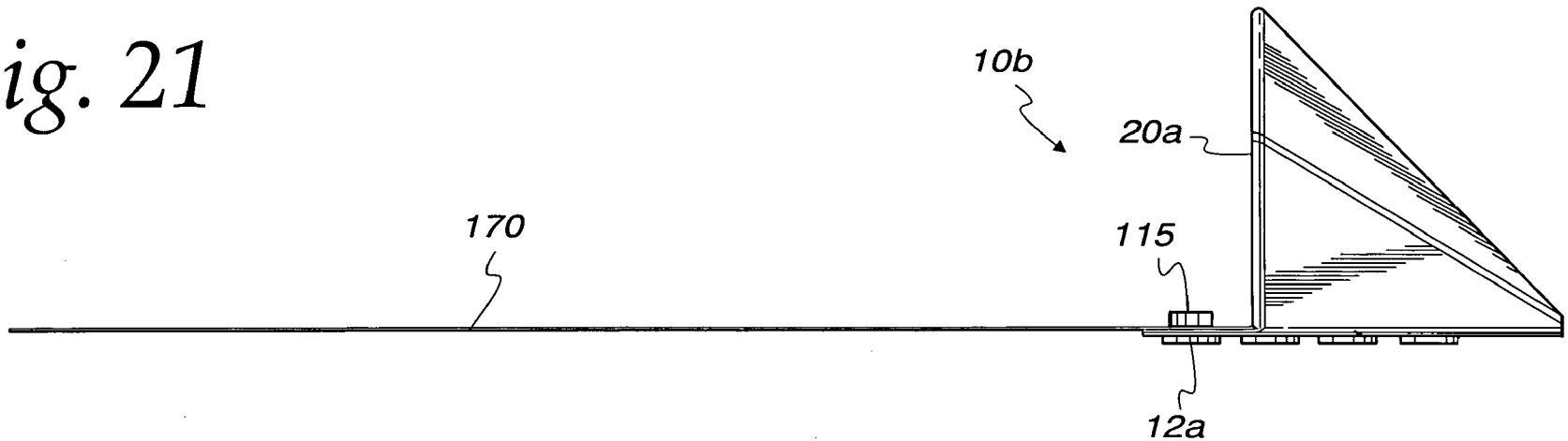
FIG. 21 is an opposite side view of the snow guard of FIG. 20.
Figure 22:
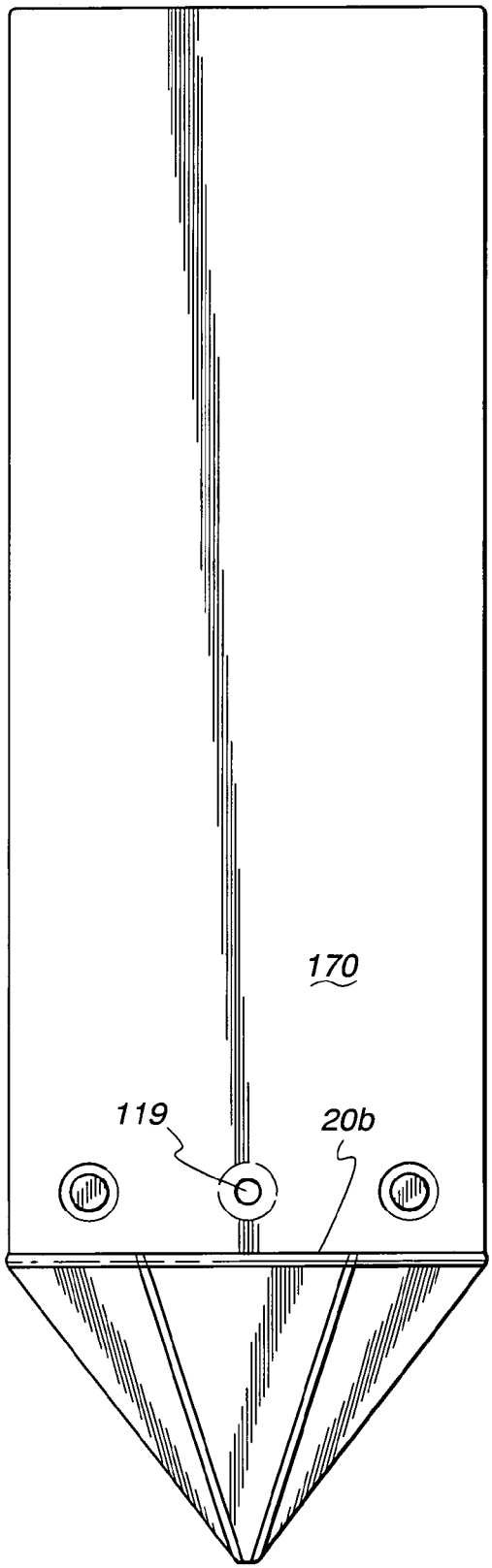
FIG. 22 is a plan view of the snow guard of FIG. 20.
Figure 23:
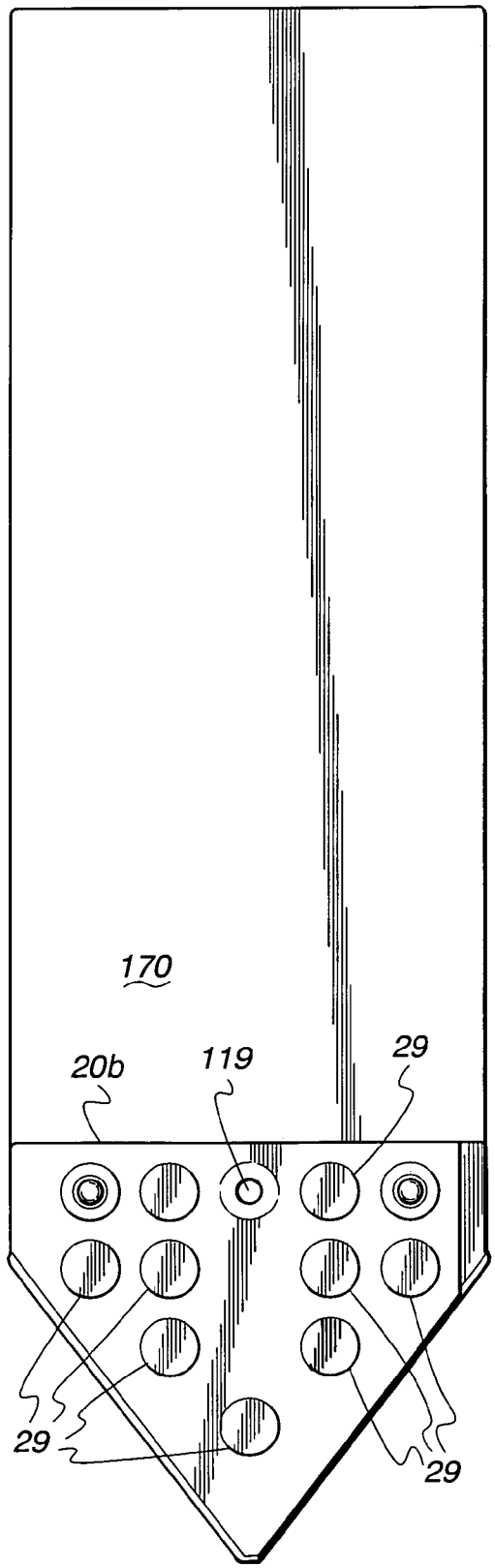
FIG. 23 is a bottom view of the snow guard of FIG. 20.

Referring now to the embodiments disclosed in FIGS. 13–24, a snow guard 10*a* in the shape of a faceted cone is provided with a base 12*a* from a plurality of upstanding walls including a rear wall 20*a* which hold the ice and snow. The rear wall 20*a* is perpendicular to the base 12*a*, as best seen in FIG. 18. A forward portion 101 of the snow guard is formed of triangular shaped panels 101*a*–101*e* (FIG. 13) joined to each other at integral fold lines 103*a*–103*d*. The larger ends of the triangularly shaped panels have downturned folded flanges 105*a*–105*e* that terminate at inner edges 107*a*–107*e* abutting the edge of the upstanding rear wall 20*a*. The flanges 105*a*–105*e* are folded along integral fold lines 109*a*–109*e* and are but slightly more than 90°. The interior of the snow guard is hollow beneath the triangularly shaped panels and in front of the upstanding wall 20*a*.

The illustrated snow guard 10 is formed of two bent sheets of metal such as copper with a second sheet having the upstanding wall 20*a* integrally joined to and bent upwardly at 90° at a fold line 114*a* to an integral horizontally extending tab or panel. The bent flanges 105*a*–105*e* abut the outer side edges of the upstanding wall 20*a* to mechanically join this first sheet having the triangular shaped panels 101*a*–101*e* and the base 12*a* to the second sheet having the upstanding wall 20*a* and rear panel 112. The first and second sheets of snow guard are also mechanically joined as by rivets 115 or upstanding metal swedge portions of the respective rear panel 112 on the second sheet and the panel of the first sheet forming the base 12*a*. That is, the rear panel 112, which is integrally joined to the upstanding wall 20*a*, is attached mechanically to the base 12*a* which is a panel that is integrally formed and attached to the triangularly shaped panels 101*a*–101*e*. The rear panel 112*a* is parallel to and lays on the rear portion of the base 12*a* and is attached thereto. Herein, the attachment between the rear panel and the base is by a pair of upstanding rivets 115. However, it is preferred to mechanically join the rear panel to the base by swedging upwardly portions of the base panel into a hole formed in the upper rear panel 112 and to force upturned metal in the upper panel with the upturned metal from the base being inwardly and concentric with the upper turned metal of the rear panel about the hole formed in each. The swaging can be done in a progressive die when forming the snow guard to avoid the cost of using rivets and a separate riveting operation when making the snow guard 10*a*.

In another embodiment 10*b* shown in FIGS. 20–23, there is provided an extension tab 170*a* for extending up under a shingle, as may be for slate roofs or the like. In the embodiments illustrated, the elongated tab 170*a* is integral with the upstanding wall 20*a* and which is laid over the rear panel 112 and secured thereto as by the rivets 115 or by the swedging operation.

The base 12*a* or 12*b* of the snow guards 10*a* or 10*b* are preferably coated with a solid solder material 25*a* in the form of projections 29 in the manner described above and hence will not be repeated now. Preferably, the solder material 25 comprises a solder layer 25*b* sealed by an overlaid flux layer 25*a*, as illustrated in FIGS. 1A and 1B.

By way of example only, the base 12*a* of 12*b* of snow guards 10*a* and 10*b* are each provided with spaced spots or areas 27 of adhesive in the form of beads or projections 29. In this illustrated embodiment, nine projections 29 are provided and are spaced by a distance in the range of 0.375 to 0.500 inch and are about 0.250 to 0.3125 inch in diameter including the outer crust of solder 25*a* over the inner layer of solder 25*b* which is soldered to the underside of the base 12*a* or 12*b*. Manifestly, the pattern size, height and/or shape of the soldering material 25 may be varied from that described herein. For example, the number and pattern of the projections 29 of soldering material is varied, as shown in FIGS. 1–12. The height of the solder projections may also be varied but about one-sixteenth inch has been found to be adequate for the illustrated snow guards. Sufficient solder is provided to assure that a good, strong, long-lasting connection of solder is achieved between the roof and the snow guard. Fasteners such as screws may also be added if desired to hold the snow guard in place while heating the soldering material.

Herein, it is preferred to make the tab portion 170 integral with the rear panel 112 and the upstanding wall 20*a*. That is, the difference between the short snow guard of FIGS. 13–18 that lack a long attachment tab 170 as in the embodiment of the snow guard 10*b*, of FIGS. 19–23 is that the horizontally extending portion of the second sheet having the upstanding wall 20*a* is longer. The only difference between the snow guard embodiments 10*a* and 10*b* is the second sheet is made long because of the integral tab 170 thereon. Thus, from a manufacturing standpoint, the snow guards 10*a* and 10*b* can be made in the same manner but using a longer second sheet for the tab 170 on the snow guard 10*b*.

Although snow guards 10, 10*a* or 10*b* made be fastened to the roof using conventional screws, nails, etc. through the holes 30 or 119, it is preferred to use the precoated solder technique described herein. The snow guard 10*a* may be provided with a view hole or opening 119 (FIG. 1) which also can be used to receive a screw or the like. Manifestly, the holes 30 or 119 may be deleted, if desired.

What is claimed is:

1. A method of attaching a metal snow guard having a base to be attached to a metal roof comprising:

providing a metal snow guard with a solid soldering material underneath on the bottom of the base;

holding the base of the snow guard on a metal roof with the solid soldering material against the roof;

applying heat to the metal snow guard soldering material to liquify the underneath soldering material; and removing the heat and allowing solidification of the soldering material to solder the base to the metal roof providing the solid soldering in the form of projections on the base to be melted.

2. A method in accordance with claim 1 comprising:

providing the solid soldering material projections with a crust of flux on the outside of the solder within the projections.

3. A method in accordance with claim 1 comprising:

sensing the relative movement of the snow guard relative to the roof as the projections melt and the soldering material flattens.

4. A method in accordance with claim 1 comprising: covering the soldering material on the base with a removable cover secured to at least the underside of the base; and removing the cover from the soldering material to do the soldering of the metal base to the metal roof.

5. A method in accordance with claim 4 comprising:

cleaning the metal roof surface at the location of the snow guard prior to holding the base of the snow guard on the roof and applying the heat.

6. A method in accordance with claim 1 comprising:

providing the base with an upper metal layer folded from a metal sheet and having the viewing holes therein; and providing the base with a lower metal layer folded from the same metal sheet and having holes therein containing the soldering material and aligned with an associated viewing hole in the upper layer.

7. A method in accordance with claim 6 comprising:

providing swedged material displaced from one metal layer into another metal layer for retaining the folded metal layers together.

8. A method in accordance with claim 1 wherein the holding of the base of the snow guard on the metal roof comprises:

using a tool to hold the snow guard at the time of heating the snow guard to liquify the solder.

9. A method in accordance with claim 1 comprising:

providing the base with four upstanding portions dividing the base plate into four sections;

providing a solid layer of flux and solder paste as the soldering material in each section;

and supplying heat and viewing the liquidification of the paste in each of the four sections when soldering the base to the metal roof.

10. A method in accordance with claim 1 comprising:

providing a viewing hole in the base and viewing solder being liquified and rising in the viewing hole.

* * * * *